US006698640B2

(12) United States Patent
Hakozaki et al.

(10) Patent No.: US 6,698,640 B2
(45) Date of Patent: Mar. 2, 2004

(54) MOTOR OPERATED STAPLER

(75) Inventors: Katsuya Hakozaki, Tokyo (JP); Shinya Abe, Tokyo (JP)

(73) Assignee: Max Co., Ltd., Tokyo (JP)

( * ) Notice: Subject to any disclaimer, the term of this patent is extended or adjusted under 35 U.S.C. 154(b) by 29 days.

(21) Appl. No.: 09/873,165

(22) Filed: Jun. 1, 2001

(65) Prior Publication Data

US 2001/0050302 A1 Dec. 13, 2001

(30) Foreign Application Priority Data

Jun. 1, 2000 (JP) ..... 2000-164272
May 15, 2001 (JP) ..... 2001-144253

(51) Int. Cl.[7] ..... B27F 7/19; B25C 7/00
(52) U.S. Cl. ..... 227/4; 227/155
(58) Field of Search ..... 227/155, 131, 227/4, 154

(56) References Cited

U.S. PATENT DOCUMENTS 1,169,339 A * 1/1916 Maynard ..... 227/155
1,852,060 A * 4/1932 Peterson ..... 227/155
4,186,863 A * 2/1980 Yunoki ..... 227/131
4,358,040 A * 11/1982 Stokes ..... 227/5
5,141,143 A 8/1992 Ebner et al.
5,238,169 A * 8/1993 Herold ..... 227/147
5,385,287 A 1/1995 Scheuten
5,775,566 A * 7/1998 Kochs et al. ..... 227/18
5,791,543 A * 8/1998 Udagawa et al. ..... 227/4
5,806,750 A 9/1998 Yamanushi et al.
5,862,971 A * 1/1999 Ebner ..... 227/155
6,056,183 A * 5/2000 Tanabe ..... 227/155

FOREIGN PATENT DOCUMENTS

EP 0 838 315 A3 8/1999 ..... B27F/7/36

* cited by examiner

*Primary Examiner*—Rinaldi I. Rada
*Assistant Examiner*—Paul Durand
(74) *Attorney, Agent, or Firm*—Chapman and Cutler LLP

(57) ABSTRACT

A motor-operated stapler is disclosed which, when a bundle of sheets to be stapled is thin, prevents staple leg portions once inserted through the bundle of sheets from again piercing through the sheets bundle and which, in the case of a thick bundle of sheets, bends staple leg portions sufficiently to staple the bundle of sheets to a satisfactory extent. In the motor-operated stapler, a clincher base which carries a bundle of sheets thereon is supported by a housing of a magazine which pushes out a U-shaped staple downward, the bundle of sheets is pinched by both the clincher base and the magazine, the U-shaped staple is pushed out from the magazine into and through the bundle of sheets, and a pair of leg portions of the staple thus projected from the bundle of sheets are bent by a pair of clinchers installed on the clincher base.

6 Claims, 6 Drawing Sheets

2
22
G
25
M
23
26
24
21
20
6
3
5
7
18
3B
3A
17
15
16
4

2
10
9
12
14
5
4B
11
13
7
3
16
19
4A
B
4
17
1

Fig. 3
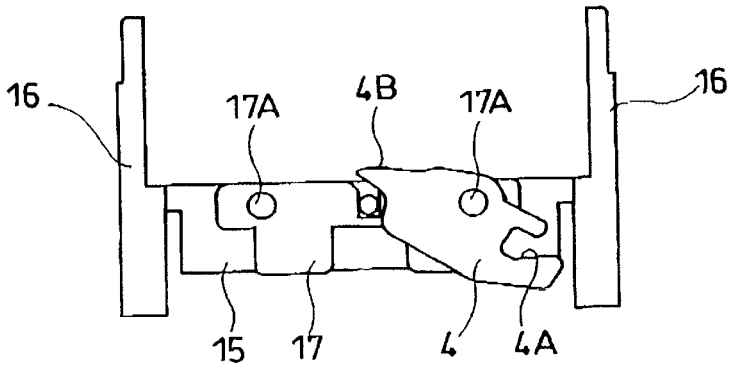
Fig. 4(A)
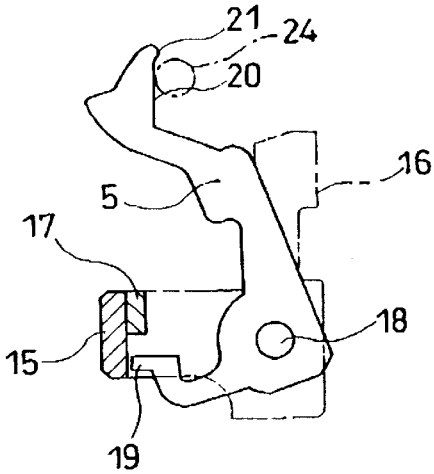
Fig. 4(B)
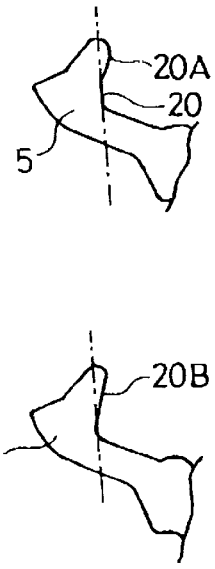
Fig. 4(C)

MOTOR OPERATED STAPLER

BACKGROUND OF THE INVENTION

1. Field of the Invention

The present invention relates to a motor-operated stapler for bending leg portions of a staple in a well-shaped state along a bundle of sheets to be stapled irrespective of the thickness of the bundle of sheets.

2. Description of the Prior Art

Heretofore there has been known a stack tray of a copying machine which tray is provided with a motor-operated stapler. In this motor-operated stapler, a large number of rectilinear wires are arranged in parallel to form sheet-like staples, then a large number of such sheet-like staples are stacked within a cartridge and are sent out one by one from a delivery port formed in the cartridge. The cartridge can be accommodated with a magazine which is provided with staple forming/drive-out means.

Below the magazine is disposed a clincher base having a flat paper carrying surface for carrying a copying paper bundle thereon. The clincher base is slidably vertically with respect to the magazine so that the copying paper carrying surface thereof can approach or leave the magazine, thereby permitting a copying paper bundle to be pinched between the magazine and the copying paper carrying surface.

A slot is formed in the copying paper carrying surface for insertion therein of leg portions of a U-shaped staple, and a pair of clinchers are disposed pivotably within the slot to bend leg portions of the staple inwards along the copying paper bundle.

The clincher base is provided with a pair of clincher links for moving the paired clinchers pivotally, the clinchers being engaged respectively with one ends of the paired clincher links.

On a magazine housing side, to which the magazine is fixed, there are provided a pair of cams for moving the paired clincher links pivotally, with opposite ends of the clincher links being engaged with the cams respectively.

The cam for moving the clincher links pivotally is rotated by means of a motor which serves as a drive source for driving the magazine and a gear mechanism.

If the paired cams are rotated when the copying paper bundle is pinched between the magazine and a clincher table of the clincher base, the opposite end portions of the paired clincher links move pivotally following the rotation of the paired cams, while one end portions of the clincher links respectively cause the clinchers to turn, thereby bending the leg portions of the staple along the copying paper bundle.

In such a conventional motor-operated stapler, however, the clincher base is held vertically movably by the housing which holds the magazine and the clincher links, which are secured with shafts to the clincher base, move pivotally after a bundle of sheets to be stapled has been held between the magazine and the clincher base, so that the amount of the pivotal movement of clincher links differ depending on the thickness of the bundle of sheets to be stapled.

Therefore, if a copying paper bundle to be stapled is thick, the length of the staple leg portions projecting from the copying paper bundle is short and the distance from an abutment point between a fulcrum of each clincher link and each cam as a drive source becomes long, so that the amount of the pivotal movement of clincher links becomes small. Consequently, the amount of the pivotal movement for bending the staple leg portions projecting from the bundle of sheets to be stapled becomes small and there easily occurs a case where the leg portions cannot be bent sufficiently, with consequent occurrence of inconveniences such as the copying paper bundle being caught on projections or the like formed on a desk.

On the other hand, in the case of a thin copying paper bundle, the staple leg portions projecting from the underside of the bundle of sheets to be stapled is long and the distance from the abutment point of the clincher line fulcrum with the driving cam becomes short, so that the amount of the pivotal movement of clincher links becomes large. Consequently, the angle of the clinchers' pivotal movement becomes large and there may occur a case where the bent leg portions of the staple again pierces through the copying paper bundle.

SUMMARY OF THE INVENTION

The present invention has been accomplished in view of the above-mentioned problems and it is an object of the invention to provide a motor-operated stapler of the type wherein a clincher base is held vertically movably on a magazine side and clincher links are pivotally moved by means of a drive source provided on the magazine side and leg portions of a staple are bent by clinchers, characterized in that the staple leg portions projecting from the underside of a bundle of sheets to be stapled can be bent at a predetermined certain angle irrespective of the thickness of the bundle of sheets to be stapled.

For achieving the above-mentioned object, according to the present invention there is provided, in the first aspect thereof, a motor-operated stapler wherein a bundle of sheets to be stapled is held by both a magazine which houses therein a staple forming mechanism and a plurality of staples and a clincher base which is movable in the thickness direction of the bundle of sheets and which is driven by a drive source provided on the magazine side, a staple is driven out from the magazine into the bundle of sheets, and leg portions of the staple projecting downward from the bundle of sheets are bent along the bundle of sheets by a pair of clinchers mounted on the clincher base, characterized by including clinchers' pivotal movement control means which keep the amount of pivotal movement of the clinchers constant irrespective of the thickness of the bundle of sheets.

In the second aspect of the present invention there is provided, in combination with the above first aspect, a motor-operated stapler further including a clincher pivoting mechanism for moving the clinchers pivotally, the clincher pivoting mechanism comprising clincher links installed on the clincher base to move the clinchers vertically pivotally, driven cam surfaces formed respectively on the clincher links and extending in the thickness direction of the bundle of sheets to be stapled, fulcrums which convert swing motions of the cam surfaces into pivotal motions of the clinchers, and driving cams installed on fixing means side which hold the magazine, the driving cams coming into contact with the driven cam surfaces of the clincher links and being rotated by the drive source provided on the magazine side, and wherein the clinchers' pivotal movement control means are formed respectively in upper areas of the driven cam surfaces with which the driving cams are in contact and are constituted respectively by projections for causing the clinchers to further turn in a direction to approach the surface of the bundle of sheets.

In the third aspect of the present invention there is provided, in combination with the above first aspect, a motor-operated stapler further including a clincher pivoting mechanism for moving the clinchers pivotally, the clincher pivoting mechanism comprising clincher links installed on the clincher base to move the clinchers vertically pivotally, driven cam surfaces formed respectively on the clincher links and extending in the thickness direction of the bundles of sheets to be stapled, fulcrums which convert swing motions of the cam surfaces into pivotal motions of the clinchers, and driving cams installed on fixing means side which hold the magazine, the driving cams coming into contact with the driven cam surfaces of the clincher links and being rotated by the drive source provided on the magazine side, and wherein the clinchers' pivotal movement control means are constructed so that when the thickness of the bundle of sheets exceeds a predetermined value with respect to the length of staple leg portions, the distance between an abutment position and each of the fulcrums which abutment position is the position of abutment between each of the clincher links and each of the clinchers is increased relatively with respect to the distance between an abutment position and each of the fulcrums which abutment position is the position of abutment between each of the clincher links and each of the driving cams.

BRIEF DESCRIPTION OF THE DRAWINGS

FIG. 3 illustrates a mounted state of only one of the clinchers which are mounted to the clincher base;

FIG. 4(A) illustrates a side shape of a clincher link, FIG. 4(B) is a partial diagram wherein a curved surface projecting gently to a driving cam side above a rectilinear portion is used as a guide surface, and FIG. 4(C) is a partial diagram wherein an inclined surface is used as a guide surface;

DETAILED DESCRIPTION OF A PREFERRED EMBODIMENT

A motor-operated stapler embodying the present invention will be described hereinunder with reference to the accompanying drawings.

Figure 1B:
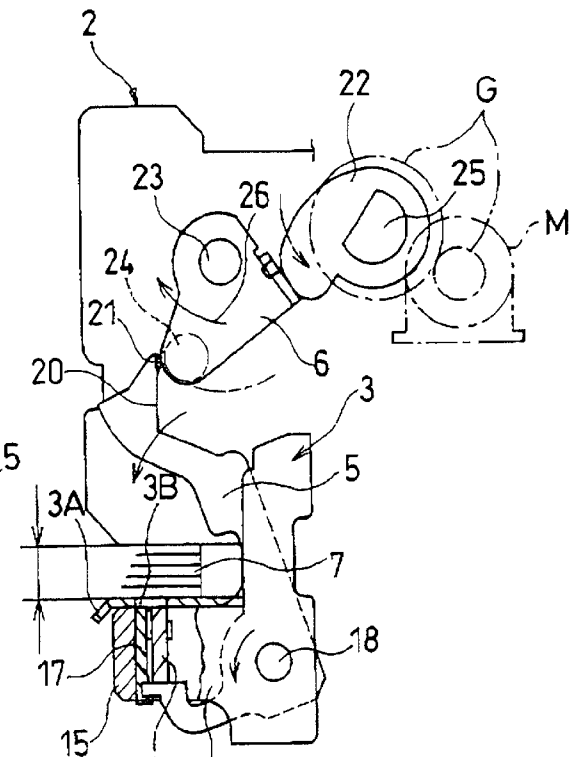
FIG. 1(B) is an enlarged view of a side portion.
Figure 1A:
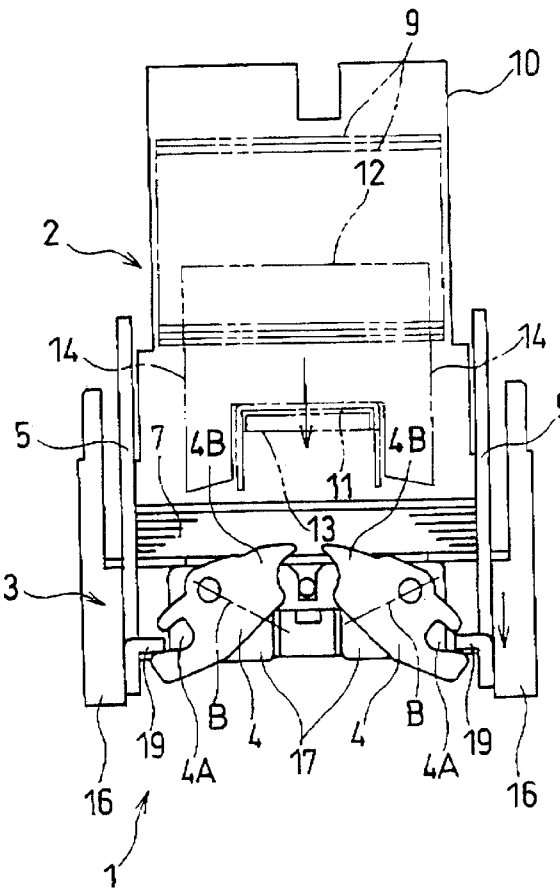
FIG. 1(A) is an enlarged front view showing a magazine and a mechanism for driving clinchers abutted against clincher links in a motor-operated stapler according to an embodiment of the present invention.

FIG. 1 illustrates the configuration of a principal mechanism for driving clinchers in the motor-operated stapler which is indicated at 1. In the same figure, the reference numeral 2 denotes a magazine, the numeral 3 denotes a clincher base, numeral 4 denotes a clincher, numeral 5 denotes a clincher link, numeral 6 denotes a driving cam, and numeral 7 denotes a bundle of sheets to be stapled.

The motor-operated stapler 1 is also provided with other mechanisms than the mechanism shown in FIG. 1, such as a control unit and a driver motor, but a principal mechanism for driving clinchers is shown in FIG. 1.

The magazine 2 has a cartridge 10 which receives therein a large number of joined staple members 9 in a stacked state, the joined staple members 9 each comprising straight wire-like staples 11 which are joined together in the shape of sheet, and a well known feeding means which send out the joined staple members 9 for each staple thickness, i.e., staple by staple, from the cartridge 10 and a driver 12 which drives out each staple 6 thus sent out into the bundle of sheets 7 after the staple has been bent in U shape by a forming plate 14.

Each joined staple member 9 comprises, say, one hundred wire-like staples 11 arranged in parallel and joined together with an adhesive so as to be separable one by one using the driver 12.

The interior of the cartridge 10 is formed so as to permit a large number of the joined staple members 9 to be accommodated therein in a stacked state and also permit the joined staple members 9 to be sent out staple by staple leftwards in FIG. 1(B) from a lower portion of the cartridge 10.

The driver 12 is for causing each U-shaped staple 11 to pierce into the bundle of sheets 7. For bending each wire-like staple 11 in U shape, as shown in FIGS. 6 to 9, there are provided an anvil 13 which supports the staple 11 and the forming plate 14 which bends both sides of the staple into U shape while the staple is carried on the anvil 13.

The driver 12 and the forming plate 14 are integrally superimposed one on the other in a front and rear relation to each other and are adapted to move together vertically.

Figure 7:
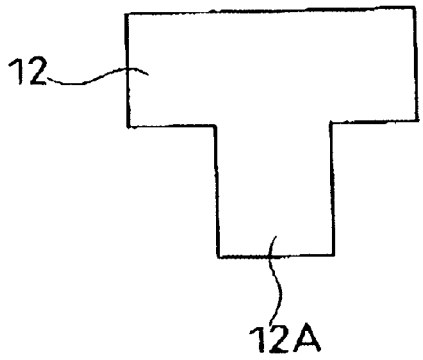
FIG. 7 is a plan view of the driver.
Figure 8:
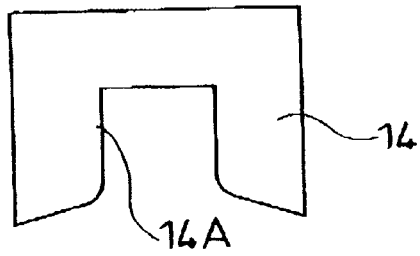
FIG. 8 is a plan view of the forming plate.

More specifically, as shown in FIG. 8, the forming plate 14 has a recess 14A for forming both sides of the wire-like staple 11 into U shape, the staple 11 being supported by the anvil 13. The driver 12, as shown in FIG. 7, has a convex portion 12A for driving out the staple 11 thus formed in U shape into the bundle of sheets 7.

Figure 6:
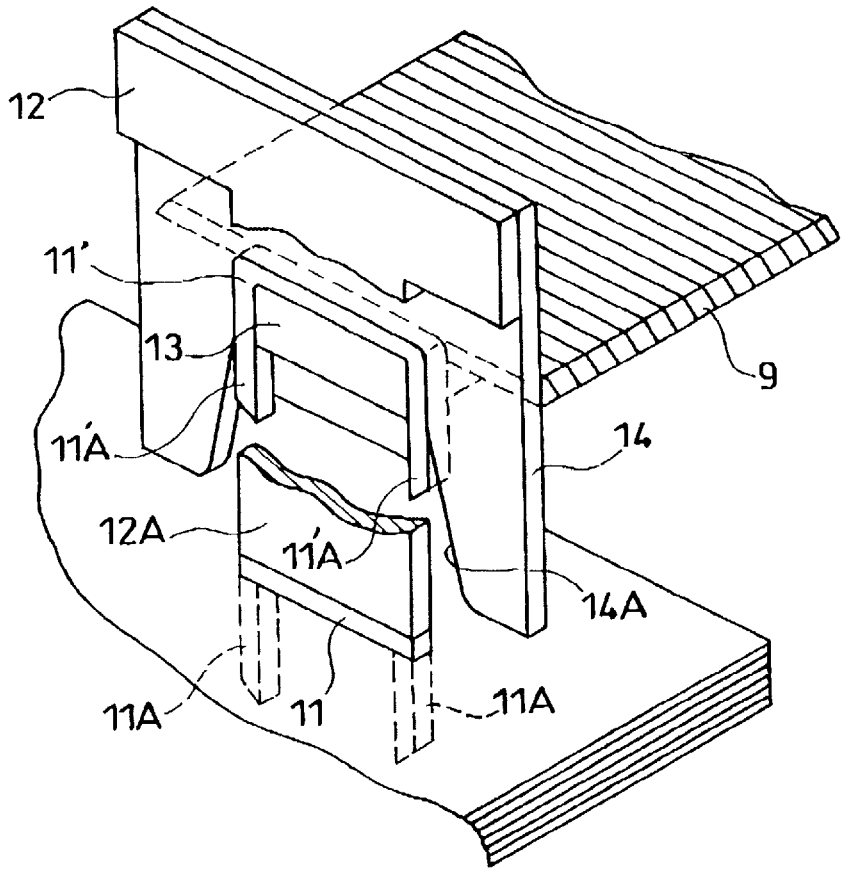
FIG. 6 is a partial perspective view showing schematically in what state a driver, an anvil and a forming plate are arranged.
Figure 9:
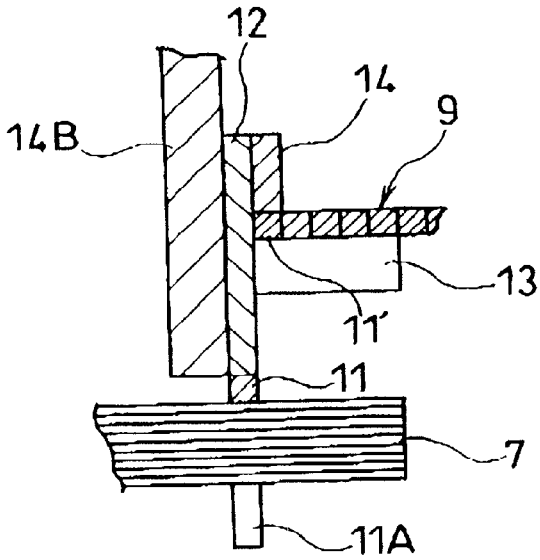
FIG. 9 is an explanatory diagram showing a positional concept in section of a staple which is formed into a predetermined shape by the driver, forming plate and anvil.

As shown in FIGS. 6 and 9, when the forming plate 14 is forming both sides of a staple 11 on the anvil 13 into U shape, the driver 12 is driving out another staple 11 which has already been formed in U shape into the bundle of sheets 7. When the forming plate 14 and the driver 12 have completed their forming and drive-out operations and move from a bottom dead center position to a top dead center position, leg portions 11A of the staple 11 which has been formed in U shape by the forming plate 14 are pushed with pushers (not shown) positioned on both sides of the anvil 13 and are abutted against a stopper plate 14B in a connected state to the joined staple member 9, the stopper plate 14B forming a front wall of a staple drive-out passage.

When the driver 12 and the forming plate 14 are retracted above the staple 11, the staple 11 which has been formed in U shape is in abutment against the stopper plate 14B in a connected state to the joined staple member 9.

As the driver 12 and the forming plate 14 move down, the staple 11 which has been formed in U shape is pushed by the driver 12 and is separated from the joined stapler member 9 and the leg portions 11A of the staple 11 begin to pierce through the bundle of sheets 7. At the same time, leg portions 11'A of a staple 11' which follows next begin to be formed in U shape by the forming plate 14.

When the driver 12 has driven out a U shaped staple 11 completely into the bundle of sheets 7, the forming plate 14 has completed its work of forming the leg portions 11'A of the next staple 11' into U shape.

When the driver 12 drives out the staple 11 into the bundle of sheets 7, upper surfaces of the paired clinchers 4 respectively face the positions of dot-dash lines B in FIG. 1.

The clincher base 3 is held vertically movably by a chassis (not shown) of the motor-operated stapler which chassis holds the magazine 2, and it is driven by a drive mechanism and a control unit both mounted to the chassis. As shown in FIG. 1(B), the drive mechanism is made up of a motor M and a gear mechanism G, while the control unit is composed of a microcomputer and a peripheral circuit connected to the microcomputer.

Near the clincher base 3 of the motor-operated stapler there is disposed a sensor for detecting that the bundle of sheets 7 has been fed. For example, the said sensor is constituted by a microswitch or an optical sensor. When the sensor detects that the bundle of sheets 7 has been put on a table 3A of the clincher base 3, the drive mechanism is operated through the control unit, whereby the clincher base 3 is moved upward and holds the bundle of sheets 7 between it and the magazine 2.

The thickness of the bundle of sheets 7 inserted between the table 3A of the clincher base 3 and the magazine 2 is set beforehand to a thickness which permits the bundle to be stapled by each staple 11. As a sensor for judging whether the thickness of the bundle of sheets 7 permits the bundle to be stapled or not, a microswitch for example is disposed within the area of movement of the clincher base 3.

For example, in the area of upper movement of the clincher base 3 is disposed a microswitch which determines an upper limit value in thickness of the bundle of sheets 7 when the clincher base 3 holds the bundle of sheets 7 between it and the magazine 2. When the microswitch detects that the thickness of the bundle of sheets 7 has exceeded the upper limit value, it sends the detected signal to the control unit.

In the case where the thickness of the bundle of sheets 7 is a thickness at which the bundle cannot be stapled by the staple 11, this state is detected, for example, by a sensor which detects the amount of movement of the clincher base 3 and the detected signal is outputted to the control unit. The control unit inhibits the driver 12 from driving out the staple 11, causes the clincher base 3 to move down, thereby releasing the bundle of sheets 7, and further causes display means, e.g., a liquid crystal display, to make a display that stapling is not performed.

Figure 2B:
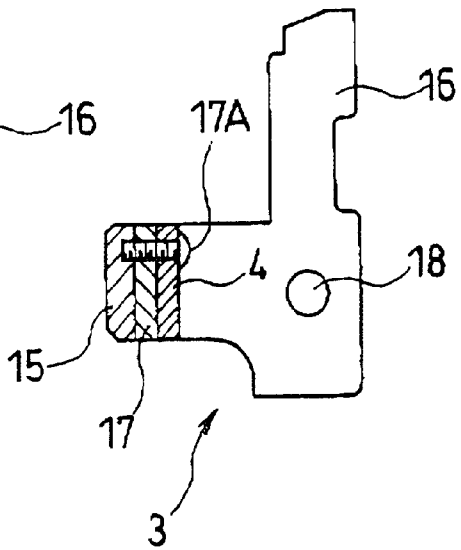
FIG. 2(A) illustrates a back configuration of a clincher base and FIG. 2(B) illustrates a side configuration of the clincher base.
Figure 2A:
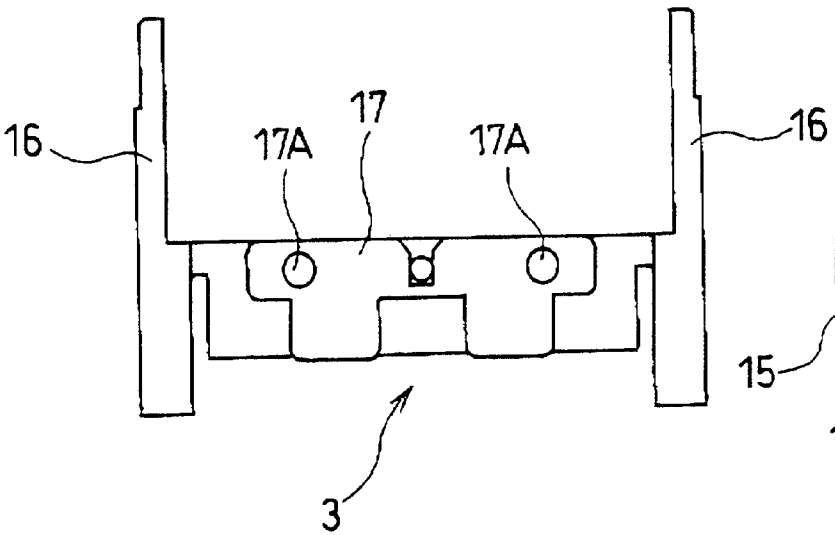

As shown in FIGS. 2(A) and 2(B), both ends of a front end portion 15 of the clincher base 3 toward which the bundle of sheets 7 is inserted are integral with L-shaped side plate portions 16 respectively. The front end portion 15 of the clincher base 3 is formed substantially in the shape of a flat plate, and spacers 17 which support the clinchers 4 are attached to the back of the front end portion 15 of the clincher base 3.

A table 3A whose front end is bent downward is fixed with screws to the clincher base 3 at a position where the bundle of sheets 7 is rested. In the table 3A, which is for carrying the bundle of sheets 7 thereon, there is formed an opening 3B permitting vertical movements of the paired clinchers 4. The opening 3B permits the clinchers 4 pass therethrough for bending the leg portions of each staple 11 in parallel with the back sheet of the bundle 7.

The pair of clinchers 4 are pivotably held respectively with pins 17A of the spacers 17 and are pulled downward from chord springs (not shown). Upper surfaces of the clinchers 4 face the positions of dot-dash lines B in FIG. 1.

The clincher links 5 are respectively supported by pins 18 (fulcrums) provided respectively on the right and left side plate portions 16 of the clincher base 3. The clincher links 5 each have a generally L-shaped side shape. At a lower end portion of each clincher link 5 is formed a cam plate portion 19 which is bent at nearly right angles from the clincher link. The cam plate portion of each clincher link 5 is inserted into a recess 4A of the associated clincher 4, whereby a pivotal motion of the clincher link 5 is transmitted to the clincher 4.

Figure 5:
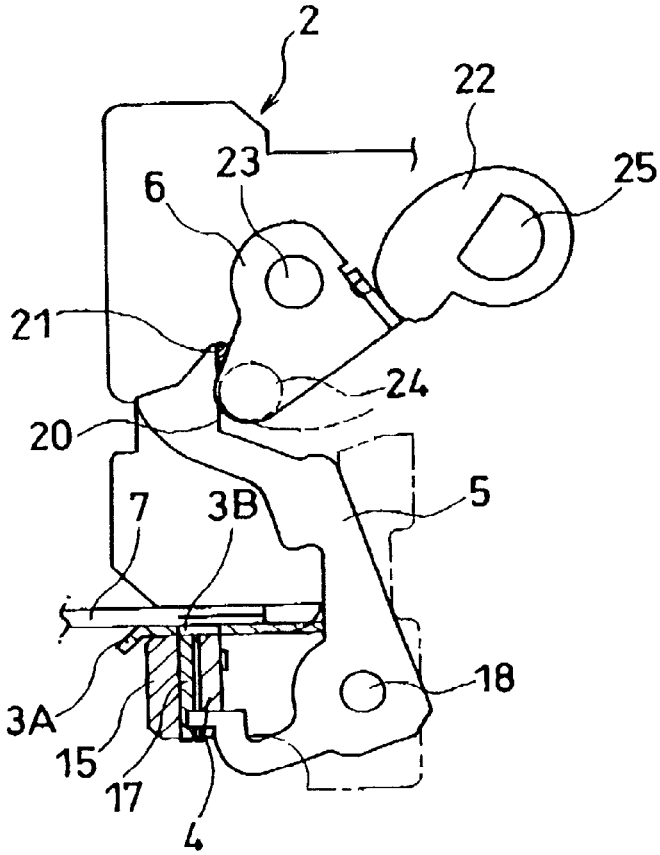
FIG. 5 illustrates a state of contact between the rectilinear portion of a clincher link and the cam in case a bundle of sheets is thin.

As shown in FIGS. 1(B), 4 and 5, an upper portion of each clincher link 5 is formed with an abutting portion 20 (a driven cam surface) for abutment therewith of the driving cam 6 with a vertical movement of the clincher base 3. With the abutting portions 20 of the paired clincher links 5, rotation of the driving cams 6 causes a pivotal motion of the clinchers 4 no matter how thick the bundle of sheets 7 may be.

An upper part of the abutting portion 20 is an area with which the driving cam 6 comes into contact when the bundle of sheets 7 is thick, and an auxiliary projection 21 is formed on the upper part of the abutting portion 20. The abutting portion 20 and the auxiliary projection 21 constitute clincher's pivotal movement control means.

The auxiliary projection 21 is for obtaining the same amount of pivotal movement of each clincher 4 as that in case of the bundle of sheet 7 being thin even when the bundle is thick, and causes the leg portions of each staple 11 to be bent along the bundle of sheets 7 in the same manner as in case of the bundle being thin even when the staple leg portions are short.

Each driving cam 6 is held with a pin 23 fixed to the chassis (fixing member, not shown) of the motor-operated stapler 1 which chassis holds and fixes the magazine 2, and is rotated by a cam 22.

A cylindrical shaft 24 is mounted to the driving cam 6 at a position at which the driving cam comes into contact with the abutting portion 20 When the driving cam 6 is rotated, the shaft 24 pushes the abutting portion 20, causing the associated clincher link 5 to turn.

The cam 22 which causes the driving cam 6 to rotate is fixed with a pin 25. The pin 25 is driven through a drive motor and a reduction mechanism (neither shown) installed in the motor-operated stapler 1.

In the motor-operated stapler 1 of this embodiment constructed as above, when the bundle of sheets 7 is carried onto the clincher base 3, the control unit and the drive mechanism both installed in the stapler 1 operate and the clincher base 3 approaches the magazine 2 until the magazine 2 and the clincher base 3 eventually pinch and hold the bundle of sheets 7 therebetween.

When the bundle of sheets 7 is held, the position of the clincher base 3 varies vertically according to the thickness of the sheets bundle, but since the abutting portions 20 of the clincher links 5 are formed correspondingly to the thickness of the sheets bundle 7, the driving cams 6 come into contact with the clincher links 5 at a nearly constant angle, so even upon rotation thereof the amount of pivotal movement of the clincher links 5 does not change according to the thickness of the sheets bundle 7, so that the clinchers 4 which pivot in accordance with the pivotal movement of the clincher links 5 are always constant in the amount of their pivotal motion. Thus, the leg, portions 11A of each staple 11 can be bent always in a constant state.

Thus, even if the thickness of the sheets bundle 7 varies, the magazine 2 and the clincher base 3 can hold the bundle therebetween.

When stapling of the sheets bundle 7 is permitted, the driving cams 6 rotate and the shafts 24 thereof push the abutting portions 20 of the clincher links 5, thus causing the clincher links 5 to turn.

When the clincher links 5 thus turn, the clinchers 4 move pivotally along the bundle of sheets 7, causing the leg portions of the staple 11 projecting from the sheets bundle to be bent along the back of the bundle.

After the leg portions of the staple 11 have thus been bent, the clincher links 5 revert to their original stand-by positions and the clinchers 4 turn below the table 3A, as is seen from the cam surface shape of the driving cams 6. Further, the clincher base 3 is retracted from the magazine 2 and the sheets bundle 7 thus stapled is released. The sheets bundle 7 thus released is then sent to a stack tray by feed rollers of a copying machine on which the motor-operated stapler 1 is mounted.

At an upper end of each abutting portion 20 in the clincher base 3 is formed the auxiliary projection 21 as clincher's pivotal movement control means to keep the pivotal movement of the associated clincher link 5 constant no matter at which position the driving cam 6 may be abutted against the abutting portion 20.

Although in the above embodiment the clincher's pivotal movement control means is constituted by the abutting portion 20 and the auxiliary projection 21, no limitation is made thereto. As clincher's pivotal movement control means, a curved surface 20A (see FIG. 4(B)) which projects gently toward the driving cam 6, or an inclined surface 20B (see FIG. 4(C)), may be formed as a guide surface above the abutting portion 20, and both this guide surface and the abutting portion 20 may constitute the clincher's pivotal movement control means.

Further, as clincher's pivotal movement control means, in order that the position of the auxiliary projection 21 can be changed, a driven cam provided with the auxiliary projection 21 may be provided separately on each clincher link 5 side so as to be vertically adjustable by an adjusting lever with use of a link mechanism or the like.

According to the motor-operated stapler in one aspect of the present invention, as set forth above, as the clincher base which carries a bundle of sheets thereon approaches the magazine, the bundle of sheets is pinched and held between the magazine and the clincher base.

Even if the thickness of the sheets bundle differs, since the driven cam surface of each clincher link extends in the thickness direction of the sheets bundle, the bundle can be pinched and held between the magazine and the clincher base irrespective of the sheets bundle thickness.

Further, after the bundle of sheets has thus been pinched, the driving cams provided on the magazine side are rotated, whereby the clincher links move pivotally and bend leg portions of a staple projecting from the bundle of sheets.

In the case of a thick bundle of sheets, the distance between the abutting point of each driving cam against the associated clincher link and the pivotal fulcrum of the clincher link becomes long, but since the clincher link is provided with pivotal movement control means, the same amount of pivotal movement as in the case of a thin bundle of sheets is ensured, so that a pair of leg portions projecting from the bundle of sheets can be bent along the back of the sheets bundle and thus even a thick bundle of sheets can be prevented from coming off the staple.

According to the motor-operated stapler in the second aspect of the present invention, since a projection for further bending the leg portions of a staple in the case of a thick sheets bundle is formed within the driven cam surface, there is no increase in the number of components and there can be attained a simple configuration and a low cost.

According to the motor-operated stapler in the third aspect of the present invention, by constituting a link mechanism in such a manner that even when the thickness of a bundle of sheets is larger than a predetermined value with respect to the length of leg portions of a staple, there is ensured the same amount of pivotal movement of each clincher as in the case of a thin sheets bundle, staple leg portions projecting from the bundle of sheets can be bent along the back of the bundle even if the bundle is thick.

Thus, according to the first to third aspects of the present invention, in a motor-operated stapler of the type wherein a clincher base which pinches and holds a bundle of sheets in cooperation with a magazine is held on the magazine side and clincher links are pivotally moved by means of a drive source provided on the magazine side, even when the distance between an abutting point of each clincher link against a driving cam and a pivotal fulcrum varies depending on the thickness of a sheets bundle, staple leg portions projecting from the underside of the sheets bundle can be bent at a predetermined certain angle. Therefore, staple leg portions are prevented from being bent to excess and again piercing through the bundle of sheets, while in the case of a thick bundle of sheets, staple leg portions can be bent to a sufficient degree, whereby the bundle of sheets can be prevented from coming off the staple leg portions.

What is claimed is:

1. A motor-operated stapler wherein a bundle of sheets to be stapled is held by both a magazine which houses therein a staple forming mechanism and a plurality of staples and a clincher base which is movable in a direction generally perpendicular to a bundle of sheets and which is driven by a drive source provided on the magazine side, a staple is driven out from said magazine into said bundle of sheets, and leg portions of the staple projecting downward through said bundle of sheets are bent along said bundle of sheets by a pair of clinchers mounted on said clincher base, and including a clincher pivotal movement control means to increase a force for clinching the staple at the bottom surface of the bundle by said clinchers, irrespective of the thickness of said bundle of sheets when the leg portions of the staple are bent along the bottom surface of the bundle of sheets;

a clincher pivoting mechanism for moving said clinchers pivotally, said clincher pivoting mechanism comprising clincher links installed on said clincher base to pivot said clinchers moving the ends vertically, driven cam surfaces formed respectively on said clincher links and extending in the thickness direction of said bundle of sheets to be stapled, fulcrums which convert swing motions of said driven cam surfaces into pivotal motions of said clinchers; and driving cams installed on the side which holds the magazine, said driving cams coming into contact with said driven cam surfaces of the clincher links and being rotated by said drive source provided on the magazine side, and wherein said pivotal movement control means are constructed so that when the thickness of said bundle of sheets exceeds a predetermined value, the distance between an abutment position and each of said fulcrums is increased relatively.

2. A motor-operated stapler, comprising:

a magazine containing a plurality of staples to be driven out of said magazine into a bundle of sheets;

a clincher base movable in thickness direction of said bundle of sheets held by both the magazine and the clincher base;

a drive source provided on the magazine side for moving the clincher base;

a pair of pivotally movable clinchers mounted on said clincher base for bending at a predetermined angle staple leg portions projecting downward from said bundle of sheets;

a control means to increase a force for clinching the staple at the bottom surface of the bundle by said clinchers, irrespective of the thickness of said bundle of sheets when the leg portions of the staple are bent along the bottom surface of the bundle of sheets;

a clincher pivoting mechanism for moving said clinchers pivotally; and driving cams installed on the side which holds the magazine, said driving cams coming into contact with said driven cam surfaces of the clincher links and being rotated by said drive source provided on the magazine side.

3. A motor-operated stapler according to claim 2, wherein said control means are formed respectively in upper areas of said driven cam surfaces with which said driving cams come into contact and are constituted respectively by projections for causing said clinchers to further turn in a direction toward a surface of said bundle of sheets.

4. A motor-operated stapler according to claim 3, wherein the control means compare the thickness value of the bundle of sheets with a predetermined value, the thickness value being provided by a thickness sensor.

5. A motor-operated stapler according to claim 4, wherein, when the thickness of said bundle of sheets exceeds the predetermined value, a distance between each of said fulcrums and an abutting point of each of said clincher links against a driving cam is increased relatively.

6. A motor-operated stapler, comprising:

a magazine containing a plurality of staples to be driven out of said magazine into a bundle of sheets;

a clincher base movable in thickness direction of said bundle of sheets held by both the magazine and the clincher base;

a drive source provided on the magazine side for moving the clincher base;

driving cams installed on a fixing means side holding said magazine;

a pair of pivotally movable clinchers mounted on said clincher base for bending at a predetermined angle staple leg portions projecting downward from said bundle of sheets;

control means to keep the amount of pivotal movement of said clinchers constant irrespective of the thickness of said bundle of sheets;

a clincher pivoting mechanism for moving said clinchers pivotally, comprising clincher links installed on said clincher base to move said clinchers pivotally in vertical direction, driven cam surfaces formed respectively on said clincher links and extending in the thickness direction of said bundle of sheets to be stapled, and fulcrums provided on clincher base to convert swing motions of said cam surfaces into pivotal movement of said clinchers;

a forming plate to form a U-shaped staple; and a driver to pierce said staple into the bundle of sheets, wherein said driving cams come into contact with said driven cam surfaces of the clincher links and being rotated by said drive source provided on the magazine side, and said control means are formed respectively on upper areas of said driven cam surfaces with which said driving cams come into contact and are constituted respectively by projections for causing said clinchers to further turn in a direction toward a surface of said bundle of sheets;

position of the clincher base varies vertically depending on the thickness of the sheet bundle;

the driving cams come into contact with the clincher links at nearly constant angle and the amount of pivotal movement of the clincher links is constant irrespective of the thickness of the bundle of sheets; and when the thickness of said bundle of sheets exceeds the predetermined value, a distance between each of said fulcrums and an abutting point formed between each of said clincher links and a driving cam is increased relatively.

* * * * *